US008807269B1

(12) United States Patent
Lucy

(10) Patent No.: US 8,807,269 B1
(45) Date of Patent: Aug. 19, 2014

(54) LOUDSPEAKER ENCLOSURE

(71) Applicant: Brian Lucy, Mesa, AZ (US)

(72) Inventor: Brian Lucy, Mesa, AZ (US)

( * ) Notice: Subject to any disclaimer, the term of this patent is extended or adjusted under 35 U.S.C. 154(b) by 0 days.

(21) Appl. No.: 13/737,921

(22) Filed: Jan. 9, 2013

Related U.S. Application Data

(60) Provisional application No. 61/584,413, filed on Jan. 9, 2012.

(51) Int. Cl.
*H04R 1/02* (2006.01)
*G10K 11/26* (2006.01)

(52) U.S. Cl.
CPC ..... *G10K 11/26* (2013.01)
USPC ..... 181/199; 181/148

(58) Field of Classification Search
USPC ..... 181/148, 150, 199; 381/332, 345, 386
See application file for complete search history.

(56) References Cited

U.S. PATENT DOCUMENTS

| | | | | | |
|---|---|---|---|---|---|
| 2,544,742 | A | * | 3/1951 | Volf | 181/145 |
| 2,806,547 | A | * | 9/1957 | Sewell | 181/156 |
| 2,840,181 | A | * | 6/1958 | Wildman | 181/199 |
| 2,866,514 | A | * | 12/1958 | Weathers | 181/151 |
| 3,143,182 | A | * | 8/1964 | Sears et al. | 181/153 |
| 3,680,658 | A | * | 8/1972 | Goeskel | 181/151 |
| 3,953,675 | A | | 4/1976 | Babb | |
| 4,173,266 | A | | 11/1979 | Pizer et al. | |
| 4,213,515 | A | | 7/1980 | Laupman | |
| 4,224,469 | A | * | 9/1980 | Karson | 381/353 |
| 4,445,730 | A | | 5/1984 | Cross | |
| 4,690,244 | A | | 9/1987 | Dickie | |
| 4,869,340 | A | | 9/1989 | Coudoux | |
| 5,602,367 | A | * | 2/1997 | Meyer | 181/156 |
| 5,710,395 | A | | 1/1998 | Wilke | |
| 2002/0036113 | A1 | * | 3/2002 | Chu | 181/199 |
| 2005/0123162 | A1 | | 6/2005 | Huffman | |
| 2006/0023910 | A1 | | 2/2006 | Tsutsumi | |
| 2006/0231327 | A1 | | 10/2006 | Stiles | |
| 2006/0231328 | A1 | | 10/2006 | Moore | |
| 2007/0158134 | A1 | * | 7/2007 | Fryette | 181/199 |
| 2008/0302595 | A1 | | 12/2008 | Moore | |
| 2009/0173567 | A1 | * | 7/2009 | Stiles | 181/148 |
| 2011/0024226 | A1 | | 2/2011 | Klein | |

FOREIGN PATENT DOCUMENTS

| | | | |
|---|---|---|---|
| CN | 2288564 | Y | 8/1998 |

* cited by examiner

*Primary Examiner* — Jeremy Luks
(74) *Attorney, Agent, or Firm* — Booth Udall Fuller, PLC

(57) ABSTRACT

A loudspeaker enclosure is disclosed that includes a plurality of exterior panels enclosing an air volume and a first brace disposed within the air volume and comprising a first reentrant through opening shaped to closely follow a profile of loudspeaker assembly components within the enclosed air volume. A loudspeaker enclosure is disclosed that includes: a plurality of exterior panels enclosing an air volume; at least one loudspeaker coupled to a front exterior panel; a first brace disposed within the air volume and comprising a first reentrant through opening; a second brace disposed within the air volume and comprising a second reentrant through opening; and a third brace disposed within the air volume and comprising a third reentrant through opening. The first, second, and third reentrant through openings are shaped to closely follow a profile of loudspeaker assembly components within the enclosed air volume.

18 Claims, 17 Drawing Sheets

LOUDSPEAKER ENCLOSURE

CROSS-REFERENCE TO RELATED APPLICATIONS

This application claims the benefit of the earlier U.S. Provisional Patent Application Ser. No. 61/584,413, filed Jan. 9, 2012, the entire disclosure of which being hereby incorporated entirely herein by reference.

BACKGROUND

1. Technical Field

This document relates to a loudspeaker enclosure.

2. Background

A loudspeaker is a device that converts electrical energy into sound that is amplified. Loudspeakers are known to cause vibration, flexure, expansion, contraction, and bending in the loudspeaker cabinets to which they are coupled. Typically, an oscillating transducer or driver is coupled to a panel of the cabinet. As the motor rapidly and powerfully extends and withdraws the diaphragm assembly, the non-moving transducer components and the cabinet structures to which they are coupled move as well. Furthermore, the oscillation of the diaphragm assembly causes pressurization and rarefaction of the air volume within the cabinet. Additionally, low and even high frequency vibrations can cause flexure of the cabinet panels.

SUMMARY

Aspects of this document relate to a loudspeaker enclosure that minimizes vibrations, flexures, expansion, contraction, and bending in the enclosure to which a loudspeaker is installed so as to provide ideal operation of the loudspeaker.

These aspects may comprise, and implementations may include, one or more or all of the components set forth in the appended CLAIMS, which are hereby incorporated by reference.

In one aspect, a loudspeaker enclosure is disclosed. The loudspeaker enclosure may include a plurality of exterior panels enclosing an air volume and a first brace disposed within the air volume and comprising a first reentrant through opening shaped to closely follow a profile of loudspeaker assembly components within the enclosed air volume.

Particular implementations may include one or more or all of the following.

The first brace may be coupled to an inside surface of a front exterior panel, a back exterior panel, a top exterior panel, and a bottom exterior panel. Specifically, back edges of the first brace adjacent the first reentrant opening may be coupled along their entire lengths to the inside surface of the back exterior panel. A top edge of the first brace may be coupled along its entire length to the inside surface of the top exterior panel. A bottom edge of the first brace may be coupled along its entire length to the inside surface of the bottom exterior panel. Front edges of the first brace adjacent the first reentrant opening may be coupled along their entire lengths to the inside surface of the front exterior panel adjacent a loudspeaker assembly.

The first reentrant through opening may be within 0.25 to 2.00 inches away from the profile of the loudspeaker assembly components within the enclosed air volume.

An edge of the first brace defining the first reentrant opening may be a beveled edge that allows air to freely flow out of a loudspeaker's rear vent.

Also included may be a second brace disposed within the air volume and including a second reentrant through opening shaped to closely follow a profile of loudspeaker assembly components within the enclosed air volume, and a third brace disposed within the air volume and including a third reentrant through opening shaped to closely follow a profile of loudspeaker assembly components within the enclosed air volume.

The second brace may be coupled to the first brace and an inside surface of a front exterior panel, a back exterior panel, and a right side exterior panel. Specifically, a back edge of the second brace may be coupled along its entire length to the inside surface of the back exterior panel. A right edge of the second brace may be coupled along its entire length to the inside surface of the right side exterior panel. A left edge of the second brace may be coupled along its entire length to a right surface of the second brace. A front edge of the second brace adjacent the second reentrant opening may be coupled along its entire length to the inside surface of the front exterior panel adjacent a loudspeaker assembly.

The second reentrant through opening may be within 0.25 to 2.00 inches away from the profile of the loudspeaker assembly components within the enclosed air volume.

An edge of the second brace defining the second reentrant opening may be a beveled edge that allows air to freely flow out of a loudspeaker's rear vent.

The third brace may be coupled to the first brace and an inside surface of a front exterior panel, a back exterior panel, and a left side exterior panel. Specifically, a back edge of the third brace may be coupled along its entire length to the inside surface of the back exterior panel. A left edge of the third brace may be coupled along its entire length to the inside surface of the left side exterior panel. A right edge of the third brace may be coupled along its entire length to a left surface of the second brace. A front edge of the third brace adjacent the third reentrant opening may be coupled along its entire length to the inside surface of the front exterior panel adjacent a loudspeaker assembly.

The third reentrant through opening may be within 0.25 to 2.00 inches away from the profile of the loudspeaker assembly components within the enclosed air volume.

An edge of the third brace defining the third reentrant opening may be a beveled edge that allows air to freely flow out of a loudspeaker's rear vent.

A left edge of the second brace may be coupled along its entire length to a right surface of the first brace opposite the third brace such that the second brace is in an orthogonal orientation with respect to the first brace, and a right edge of the third brace may be coupled along its entire length to a left surface of the first brace opposite the second brace such that the third brace is in an orthogonal orientation with respect to the first brace.

A wind port may be included. The wind port may include a splitter that transitions into four through aerodynamic pathways defined by four orthogonal wall member pairs, respectively, that fit over an intersection of the first brace with both the second brace and the third brace.

The wind port may be within 0.125 to 2.000 inches away from the profile of the loudspeaker assembly components within the enclosed air volume.

In another aspect, a loudspeaker enclosure is disclosed. The loudspeaker enclosure may include a plurality of exterior panels enclosing an air volume. At least one loudspeaker may be coupled to a front exterior panel so as to have a front diaphragm surface exposed to a listening space and a rear diaphragm surface exposed to the enclosed air volume. A first brace may be disposed within the air volume and includes a first reentrant through opening shaped to closely follow a profile of loudspeaker assembly components within the enclosed air volume, the first brace coupled to an inside surface of a front exterior panel, a back exterior panel, a top exterior panel, and a bottom exterior panel. A second brace may be disposed within the air volume and includes a second reentrant through opening shaped to closely follow a profile of loudspeaker assembly components within the enclosed air volume, the second brace coupled to the first brace and an inside surface of a front exterior panel, a back exterior panel, and a right side exterior panel. A third brace may be disposed within the air volume and includes a third reentrant through opening shaped to closely follow a profile of loudspeaker assembly components within the enclosed air volume, the third brace coupled to the first brace and an inside surface of a front exterior panel, a back exterior panel, and a left side exterior panel.

Particular implementations may include one or more or all of the following.

An edge of the first brace defining the first reentrant opening, an edge of the second brace defining the second reentrant opening, and an edge of the third brace defining the third reentrant opening each may be a beveled edge that allows air to freely flow out of a loudspeaker's rear vent.

A wind port may be included that includes a splitter that transitions into four through aerodynamic pathways defined by four orthogonal wall member pairs, respectively, that fit over an intersection of the first brace with both the second brace and the third brace.

The foregoing and other aspects, features, and advantages will be apparent to those of ordinary skill in the art from the DESCRIPTION and DRAWINGS, and from the CLAIMS.

BRIEF DESCRIPTION OF DRAWINGS

Implementations will hereinafter be described in conjunction with the appended DRAWINGS (which are not necessarily to scale), where like designations denote like elements, and.

DESCRIPTION

Figure 1:
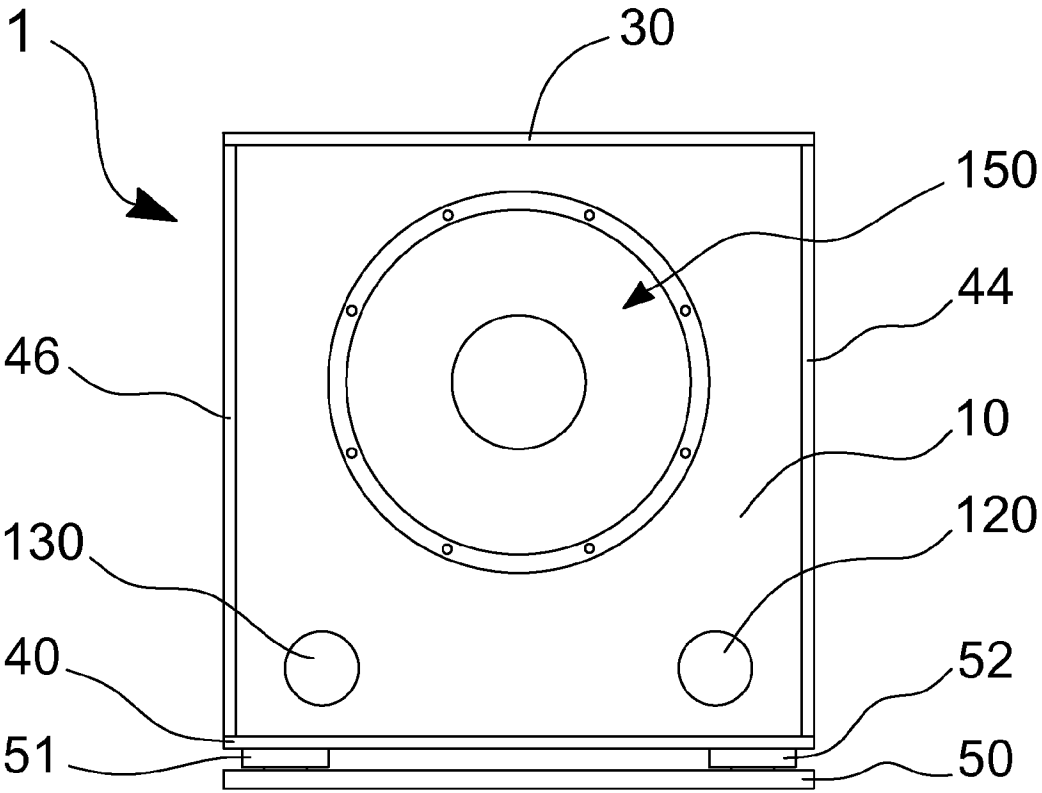
FIG. 1 is a front view of an implementation of a loudspeaker enclosure.
Figure 2:
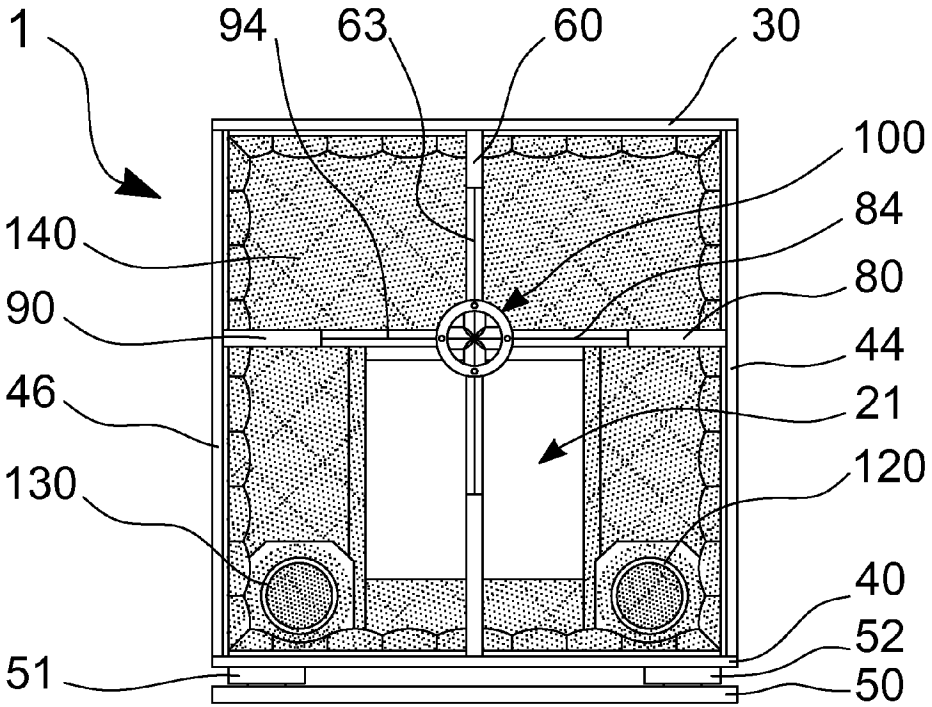
FIG. 2 is a front view of the loudspeaker enclosure of FIG. 1 with the front panel and loudspeaker removed.
Figure 3:
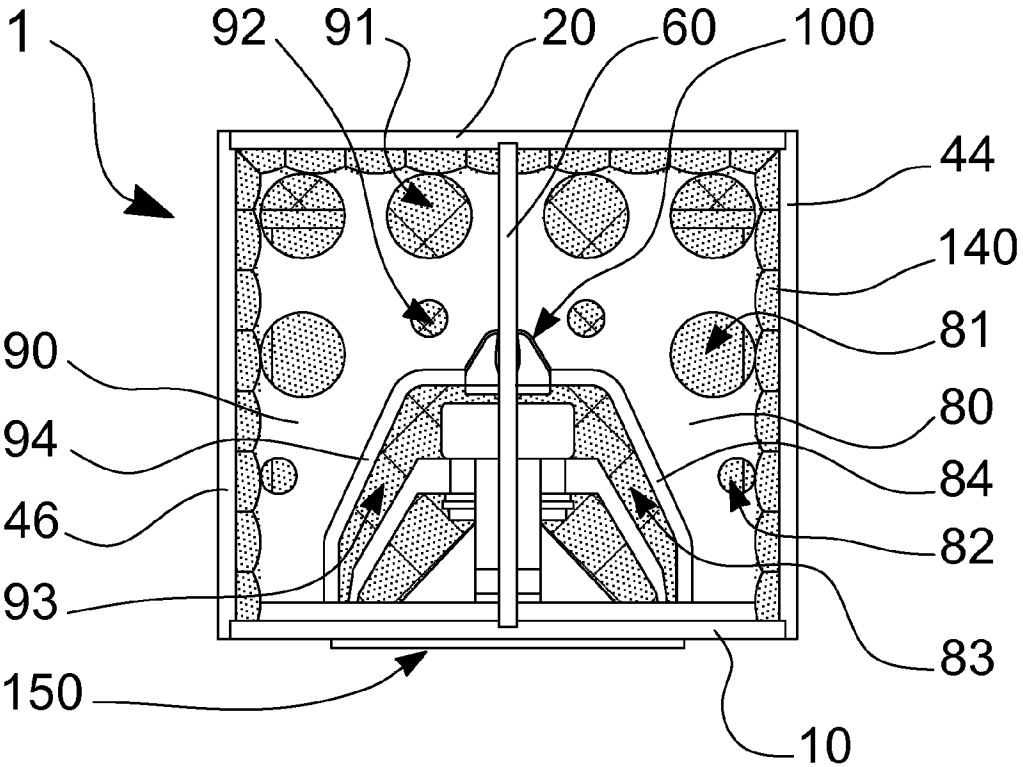
FIG. 3 is a top view of the loudspeaker enclosure of FIG. 1 with the top panel removed.
Figure 4:
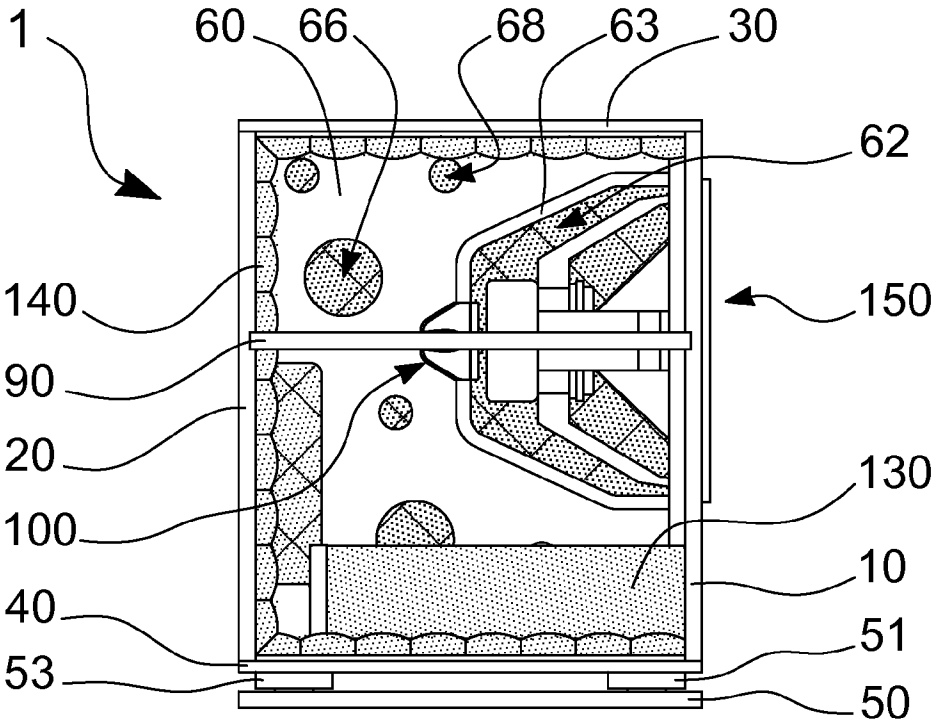
FIG. 4 is a left side view of the loudspeaker enclosure of FIG. 1 with the left side panel removed.
Figure 5:
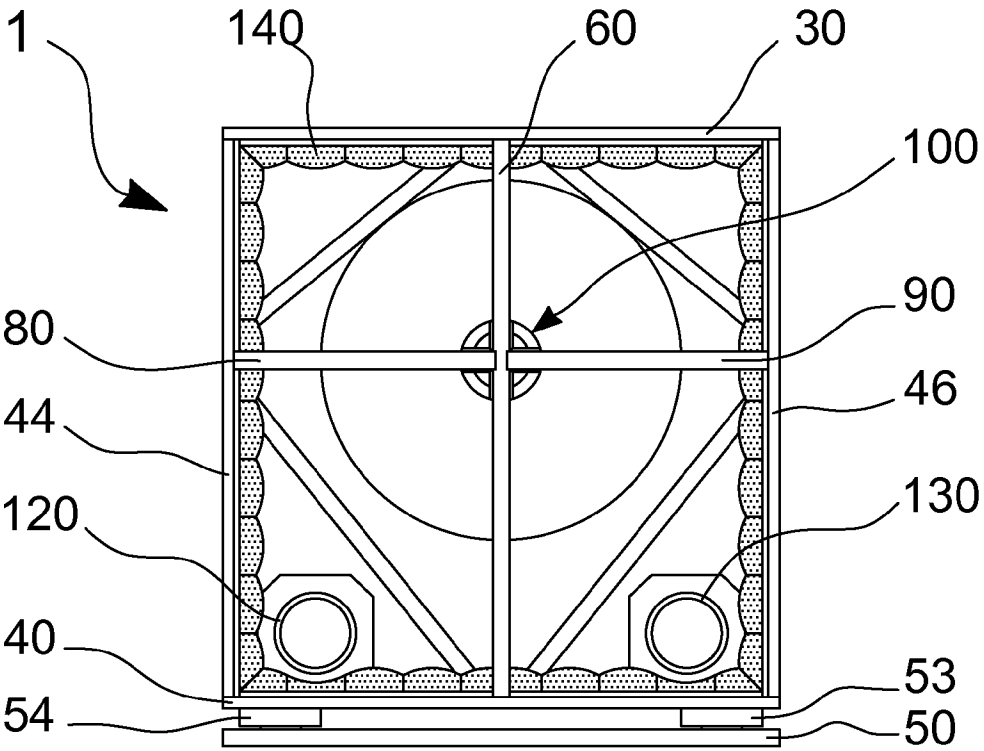
FIG. 5 is a back view of the loudspeaker enclosure of FIG. 1 with the back panel removed.

This document features loudspeaker enclosure implementations. There are many features of loudspeaker enclosure implementations disclosed herein, of which one, a plurality, or all features or steps may be used in any particular implementation.

In the following description, reference is made to the accompanying DRAWINGS which form a part hereof, and which show by way of illustration possible implementations. It is to be understood that other implementations may be utilized, and structural, as well as procedural, changes may be made without departing from the scope of this document. As a matter of convenience, various components will be described using exemplary materials, sizes, shapes, dimensions, and the like. However, this document is not limited to the stated examples and other configurations are possible and within the teachings of the present disclosure.

Structure

There are a variety of loudspeaker enclosure implementations that that allow for greatly improved sound clarity, cabinet rigidity and lower frequency response. These implementations provide a place to physically mount the loudspeaker(s) and to prevent sound waves emanating from the back of a driver from interfering destructively with those from the front by containing the rear radiation from the moving diaphragm. A sealed enclosure prevents transmission of the sound emitted from the rear of the loudspeaker by confining the sound in a rigid and airtight area so that cancellations (e.g., comb filtering) are prevented and the level and quality of sound at low frequencies is not altered.

Notwithstanding, turning to FIGS. 1-17 and for the exemplary purposes of this disclosure, loudspeaker enclosure 1 is shown.

Loudspeaker enclosure 1 generally includes front panel 10, back panel 20, top panel 30, bottom panel 40, right side panel 44, left side panel 46, and base panel 50, each of which may be termed an exterior panel, whether or not directly exposed to the external listening space. One or more of the panels, such as front panel 10, are provided with one or more loudspeaker assemblies 150 for example, each of which includes a diaphragm whose front surface is exposed to the listening space and whose rear surface is exposed to the air enclosed within loudspeaker enclosure 1. One or more of the panels, such as back panel 20 for example, may also be provided with other equipment, such as an amplifier (not shown).

The exterior panels may be coupled together by any suitable means. For example, the panels may be held in grooves cut into the internal surfaces of the exterior panels, and may be affixed with adhesive and/or screws (not shown). Base panel 50 may be coupled to bottom panel 40 through spacers 51, 52, 53, and 54, which may be located adjacent the respective corners of base panel 50 and bottom panel 40 so that the two panels are aligned.

Front panel 10 may include through hole 11 configured to receive and support loudspeaker assembly 150, along with tube port through holes 12 and 13. Also included may be intersecting grooves 14, 15, 16, and 17 defined on its internal surface.

Back panel 20 may include through hole 21 configured to receive and support an amplifier for example, along with intersecting grooves 22, 23, and 24 defined on its internal surface.

Bottom panel 40 may include perimeter groove 41 and bisecting groove 42 defined on its internal surface. Top panel 30 may not include any grooves, or may also include perimeter groove 41 and bisecting groove 42 defined on its internal surface.

Right side panel 44 and left side panel 46 may include bisecting grooves 45 and 47, respectively, defined on their internal surfaces. Right side panel 44 and left side panel 46 may also each include opposing perimeter grooves along portions of its perimeter defined on its internal surface.

The internal brace assembly is configured to deaden the inside of enclosure 1, to improve strength and rigidity for the X-axis, Y-axis, and Z-axis of enclosure 1 (reduce expansion and flexure to shift the exterior panels' resonance to higher frequencies), and to provide on-axis alignment with the speaker's voice coil and vent; closely following the outside dimensions of the loudspeaker. The shape of internal brace assembly is designed to reduce internal sound reflections by directing sounds away from the loudspeaker diaphragm, where damping material 140 may then absorb them.

The internal brace assembly may include brace 60 and braces 80 and 90. Internal braces 60, 80, and 90 may divide the enclosed air space into four separate, isolated volumes, if desired, or, as shown, if the internal braces 60, 80, and 90 are provided with holes, the enclosed air remains a single effective air volume.

Accordingly, brace 60 may include a plurality of through holes 66 and 68 that are configured to allow the enclosed air to remain a single effective air volume. Intersecting grooves 70 may be defined on its opposing surfaces, respectively. Reentrant through openings 62 and 64 may also be included. Reentrant through opening 62 is shaped to closely follow the outside dimensions or profile of the loudspeaker assembly components within the enclosed air volume. That is, when brace 60 is installed, reentrant through opening 62 is closely adjacent to the outside dimensions or profile of the loudspeaker assembly components within the enclosed air volume. For example, reentrant through opening 62 may be within 0.25 to 2.00 inches away from the profile of the loudspeaker assembly components within the enclosed air volume.

Reentrant through opening 62 may include or define beveled edge 63 (that is, the edge 63 of brace 60 defining reentrant opening 62 may be beveled). Beveled edge 63 may include a single bevel or a double bevel. Beveled edge 63 allows air too freely flow in and out of the loudspeaker's rear vent (to breath freely).

Braces 80 and 90 may include a plurality of through holes 81 and 82 and 91 and 92, respectively, and are configured to allow the enclosed air to remain a single effective air volume. Reentrant through openings 83 and 93, respectively, of brace s80 and 90 together form a reentrant through opening 96 when braces 80 and 90 are each coupled to one of opposing grooves 70 of brace 60. Reentrant through openings 83, 93 and 96 are shaped to closely follow the outside dimensions or profile of the loudspeaker assembly components within the enclosed air volume. That is, when braces 80 and 90 are installed, reentrant through openings 83, 93 and 96 are closely adjacent to the outside dimensions or profile of the loudspeaker assembly components within the enclosed air volume. For example, reentrant through openings 83, 93 and 96 may be within 0.25 to 2.00 inches away from the profile of the loudspeaker assembly components within the enclosed air volume.

Reentrant through openings 83 and 93 may include or define beveled edges 84 and 94, respectively (that is, the edges 84 and 94 of braces 80 and 90, respectively, defining reentrant openings 83 and 93, respectively, may be beveled). Beveled edges 84 and 94 may each either be a single bevel edge or a double bevel edge. Beveled edges 84 and 94 allow air too freely flow in and out of the loudspeaker's rear vent (to breath freely).

If the loudspeaker 150 is not vented or ported, braces 60, 80, and 90 can still stiffen and strengthen the loudspeaker enclosure 1.

The internal braces 60, 80, and 90 are coupled to their respective exterior panels by any suitable means. For example, the braces 60, 80, and 90 may be held in grooves cut into the internal surfaces of the exterior panels, and may be affixed with adhesive and/or screws (not shown). Braces 60, 80, and 90 extend completely over the cross-sectional area of the air volume.

Accordingly, brace 60 is coupled to the inside surfaces of front panel 10, back panel 20, top panel 30, and bottom panel 40. Specifically, the back edges adjacent reentrant opening 64 of brace 60 are coupled along their entire lengths to the inside surface of back panel 20, the top edge of brace 60 is coupled along its entire length to the inside surface of top panel 10, the bottom edge of brace 60 is coupled along its entire length to the inside surface of bottom panel 40, and the front edges adjacent reentrant opening 62 of brace 60 are coupled along their entire lengths to the inside surface of front panel 10 adjacent loudspeaker assembly 150.

Similarly, brace 80 is coupled to the inside surfaces of front panel 10, back panel 20, and right side panel 44. Specifically, the back edge of brace 80 is coupled along its entire length to the inside surface of back panel 20, the right edge of brace 80 is coupled along its entire length to the inside surface of right side panel 44, the left edge of brace 80 is coupled along its entire length to the right surface of brace 60, and the front edge adjacent reentrant opening 83 of brace 80 is coupled along its entire length to the inside surface of front panel 10 adjacent loudspeaker assembly 150.

Likewise, brace 90 is coupled to the inside surfaces of front panel 10, back panel 20, and left side panel 46. Specifically, the back edge of brace 90 is coupled along its entire length to the inside surface of back panel 20, the left edge of brace 90 is coupled along its entire length to the inside surface of left side panel 46, the right edge of brace 90 is coupled along its entire length to the left surface of brace 60, and the front edge adjacent reentrant opening 93 of brace 80 is coupled along its entire length to the inside surface of front panel 10 adjacent loudspeaker assembly 150.

Internal braces 60 and 80 and 90 may be oriented in a variety of different manners. As shown, edges of braces 80 and 90 are coupled to opposite sides of brace 60 such that braces 80 and 90 are in an orthogonal orientation with respect to brace 60 (e.g., the braces form a cross from a front or rear view). However, braces 80 and 90 can be positioned at any orientation with respect to brace 60.

Wind port 100 is configured to allow air to flow freely over the internal brace assembly. That is, wind port 100 allows the air generated by loudspeaker 150 to move smoothly over the internal brace assembly.

Wind port 100 is in very close proximity to the profile of the loudspeaker assembly components within the enclosed air volume. For example, wind port 100 may be within 0.125 to 2.00 inches away from the profile of the loudspeaker assembly components within the enclosed air volume. In turn, this allows the internal brace assembly to strengthen the exterior panels of loudspeaker enclosure 1 (that would otherwise be without it).

Wind port 100 includes retaining ring 114 and a splitter coupled to retaining ring 114 that flares and transitions into four through aerodynamic pathways 103, 106, 109, and 112 defined by orthogonal wall member pairs 101 and 102, 104 and 105, 107 and 108, and 110 and 111, respectively. This design allows wind port 100 to fit precisely over the intersection of brace 60 with braces 80 and 90 using retaining ring 114 and screws 116 and orthogonal wall member pairs 101 and 102, 104 and 105, 107 and 108, and 110 and 111, thereby allowing air too freely flow in and out of the speaker's rear vent (to breath freely).

Damping material 140 is configured to deaden the inside walls of enclosure 1. Various damping materials 140 may be added against the internal surfaces of the exterior panels of enclosure 1 to absorb and reduce vibrations in the enclosed air itself. Damping material 140 may be in the form of a quilt, providing a non-flat pattern to absorb direct, reflected and vibrations inside enclosure 1. Such an uneven or quilted damping material 140 provides greatly improved low-end frequency response for enclosure 1. The pattern of the quilt may be an evenly spaced square-grid pattern. Each section can be 4 to 6 inches for example. Each section of the quilt may be held in place with a simple fiberglass screen, ¼" upholstery nail and ½" plastic washer, adhesive, or the like. Damping material 140 may be glass wool, wool, or synthetic fiber batting for example.

The purpose of tube ports 120 and 130 are to allow air and sound energy to move inside and outside the port, without notable tube-wall and tube-end vibration. Tube ports 120 and 130 are rigid and strong parts of loudspeaker enclosure 1.

Each tube port 120 and 130 includes a hollow tube member. The tube member may be cylindrical. For example, the tube member may be extruded (air-core) PVC tube. Each tube port 120 and 130 provides greatly improved low-end frequency response for loudspeaker enclosure 1. In addition, tube ports 120 and 130 strengthen loudspeaker enclosure 1. A PVC tube is much thicker than the standard adjustable or screw-in port. It provides a very strong, structural link between front panel 10 and bottom panel 40 of loudspeaker enclosure 1. Acoustic performance improves by being mounted at the bottom of loudspeaker enclosure 1 and away from loudspeaker assembly 150 (e.g. a high-powered subwoofer-driver).

Loudspeaker assembly 150 may include any loudspeaker (an electroacoustic transducer that converts an electrical signal into sound). The term "loudspeaker" may refer to individual transducers (known as "drivers"). Individual drivers are used to reproduce different frequency ranges. The drivers are named subwoofers (for very low frequencies), woofers (low frequencies), mid-range speakers (middle frequencies), and tweeters (high frequencies). The loudspeaker moves in accordance with the variations of an electrical signal and causes sound waves to propagate through air.

The most common type of driver uses a lightweight diaphragm, or cone, connected to a rigid basket, or frame, via a flexible suspension that constrains a coil of fine wire to move axially through a cylindrical magnetic gap. When an electrical signal is applied to the voice coil, a magnetic field is created by the electric current in the voice coil, making it a variable electromagnet. The coil and the driver's magnetic system interact, generating a mechanical force that causes the coil (and thus, the attached cone) to move back and forth, thereby reproducing sound under the control of the applied electrical signal coming from the amplifier.

Many additional implementations are possible. Further implementations are within the CLAIMS Specifications Materials Manufacture Assembly It will be understood that implementations are not limited to the specific components disclosed herein, as virtually any components consistent with the intended operation of a loudspeaker enclosure implementation may be utilized. Accordingly, for example, although particular components and so forth, are disclosed, such components may comprise any shape, size, style, type, model, version, class, grade, measurement, concentration, material, weight, quantity, and/or the like consistent with the intended operation of a loudspeaker enclosure implementation. Implementations are not limited to uses of any specific components, provided that the components selected are consistent with the intended operation of a loudspeaker enclosure implementation.

Accordingly, the components defining any loudspeaker enclosure implementation may be formed of any of many different types of materials or combinations thereof that can readily be formed into shaped objects provided that the components selected are consistent with the intended operation of a loudspeaker enclosure implementation. For example, the components may be formed of: woods, wood composites, and/or other like materials, such as MDF; rubbers (synthetic and/or natural) and/or other like materials; glasses (such as fiberglass), carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, spring steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Various loudspeaker enclosure implementations may be manufactured using conventional procedures as added to and improved upon through the procedures described here. Some components defining loudspeaker enclosure implementations may be manufactured simultaneously and integrally joined with one another, while other components may be purchased pre-manufactured or manufactured separately and then assembled with the integral components.

Manufacture of these components separately or simultaneously may involve extrusion, pultrusion, vacuum forming, injection molding, blow molding, resin transfer molding, casting, forging, cold rolling, milling, drilling, routing, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components.

It will be understood that the assembly of loudspeaker enclosure implementations are not limited to the specific order of steps as disclosed in this document. Any steps or sequence of steps of the assembly of loudspeaker enclosure implementations indicated herein are given as examples of possible steps or sequence of steps and not as limitations, since various assembly processes and sequences of steps may be used to assemble loudspeaker enclosure implementations.

Use

Implementations of loudspeaker enclosures are particularly useful in subwoofer applications. However, implementations are not limited to uses relating to subwoofer applications. Rather, any description relating to subwoofer applications is for the exemplary purposes of this disclosure, and implementations may also be used in a variety of other loudspeaker/transducer applications with similar results.

Figure 6:
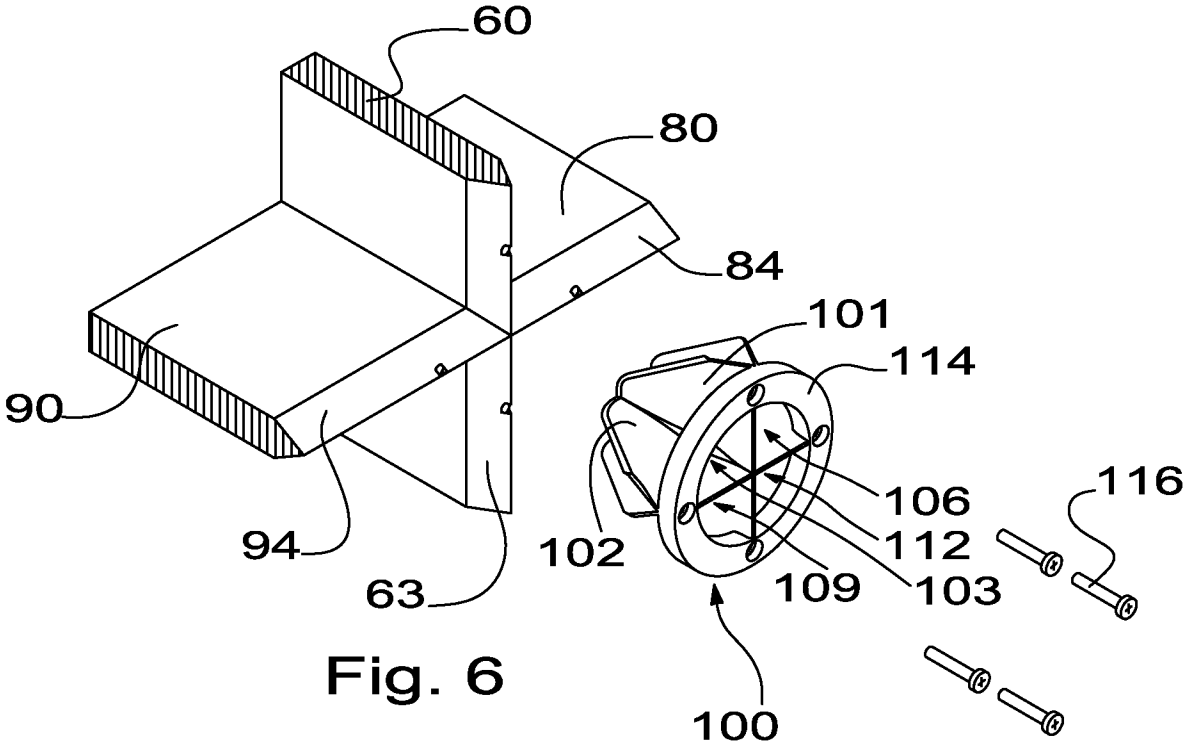
FIG. 6 is a partially broken away exploded perspective view of the wind port and internal bracing members of the loudspeaker enclosure of FIG. 1.
Figure 7:
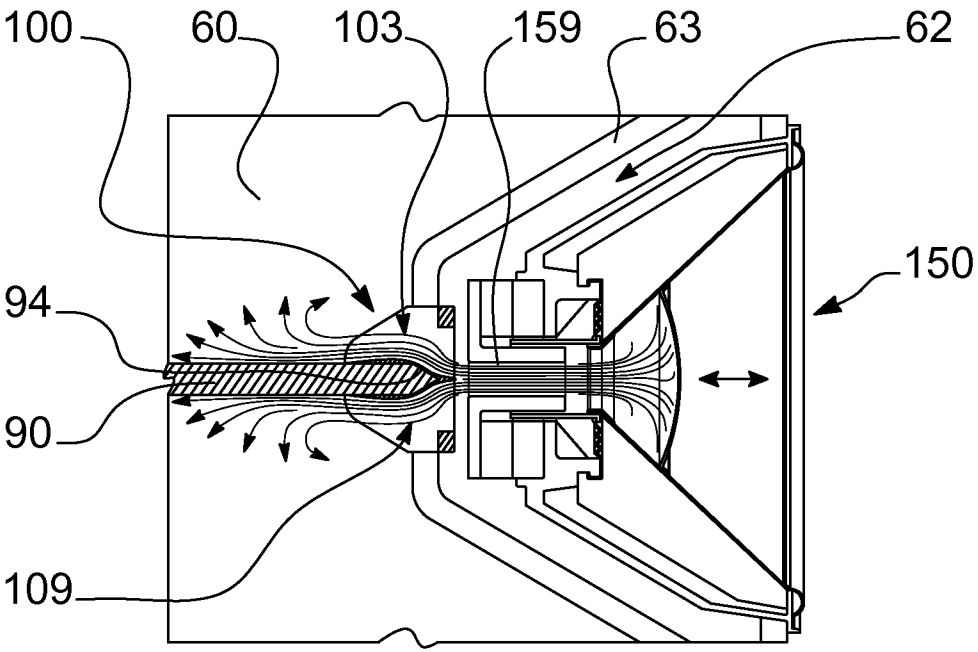
FIG. 7 is a vertical cross-sectional view through the loudspeaker and the horizontal bracing member of the loudspeaker enclosure of FIG. 1.
Figure 8:
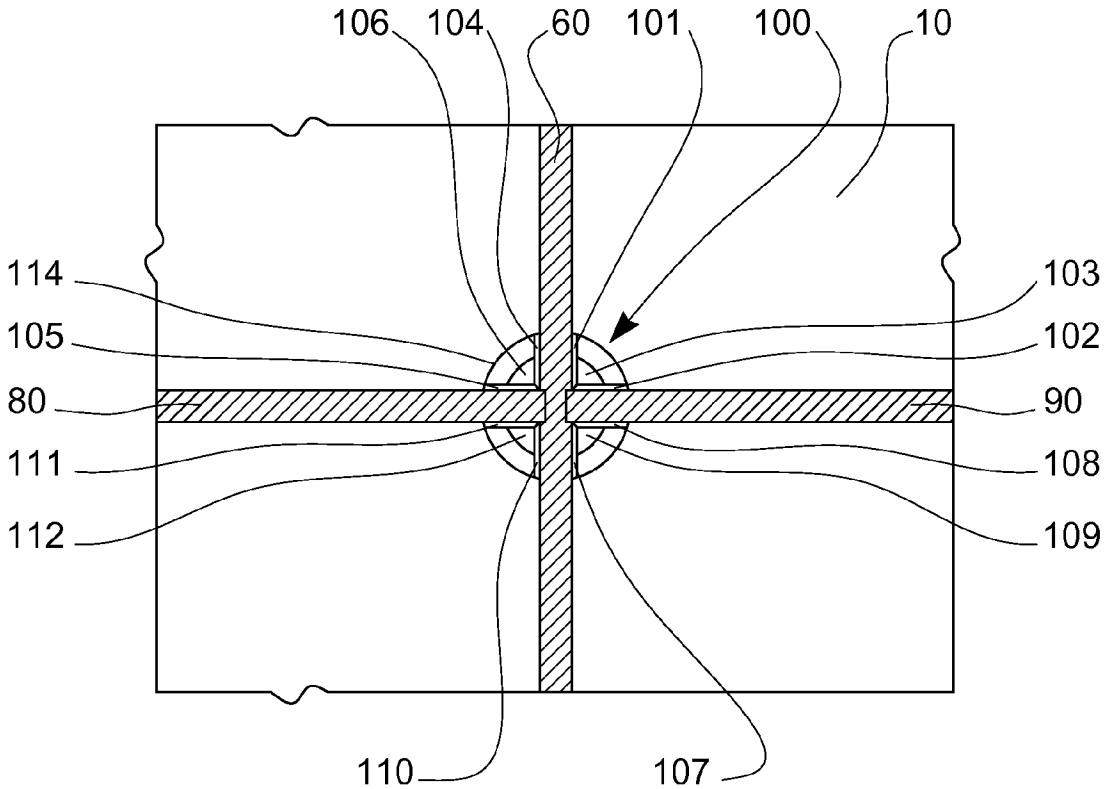
FIG. 8 is a partially broken away back view of the wind port and internal bracing members of the loudspeaker enclosure of FIG. 1.
Figure 9:
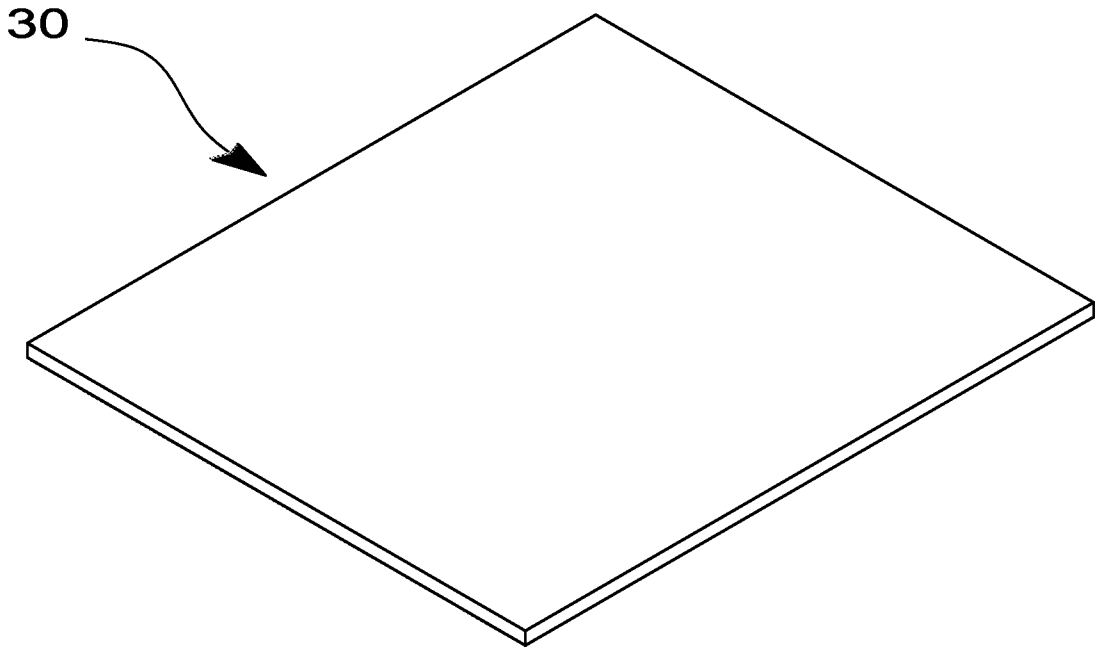
FIGS. 9-17 are perspective views of the top panel, the back panel, the front panel, the bottom panel, the base panel, the horizontal panels, the vertical panel, the right side panel, and the left side panel, respectively, the loudspeaker enclosure of FIG. 1.
Figure 10:
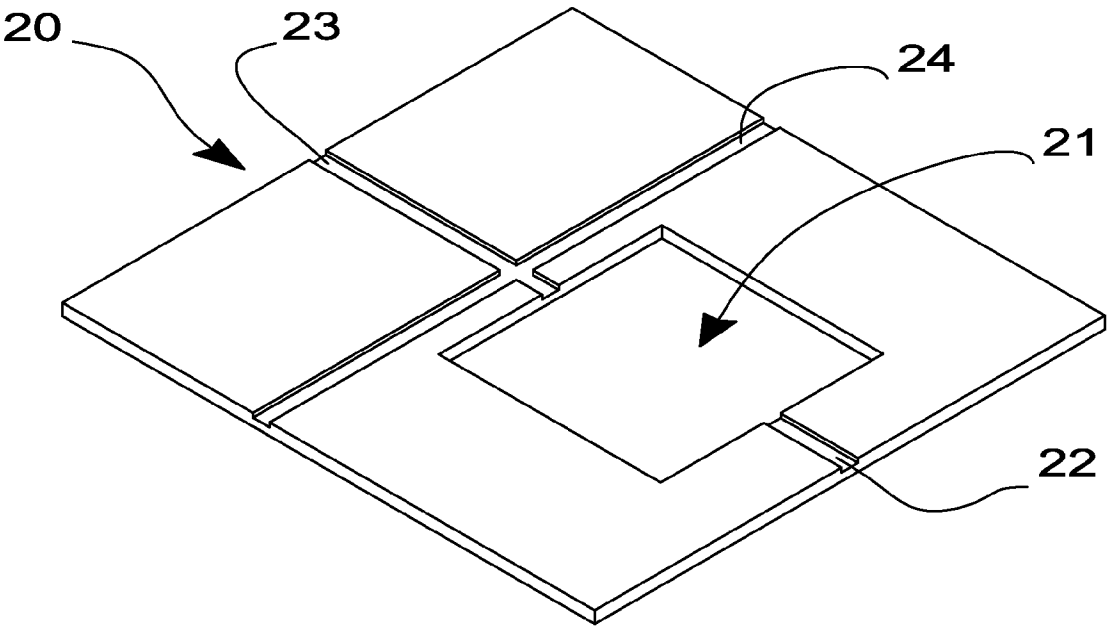
Figure 11:
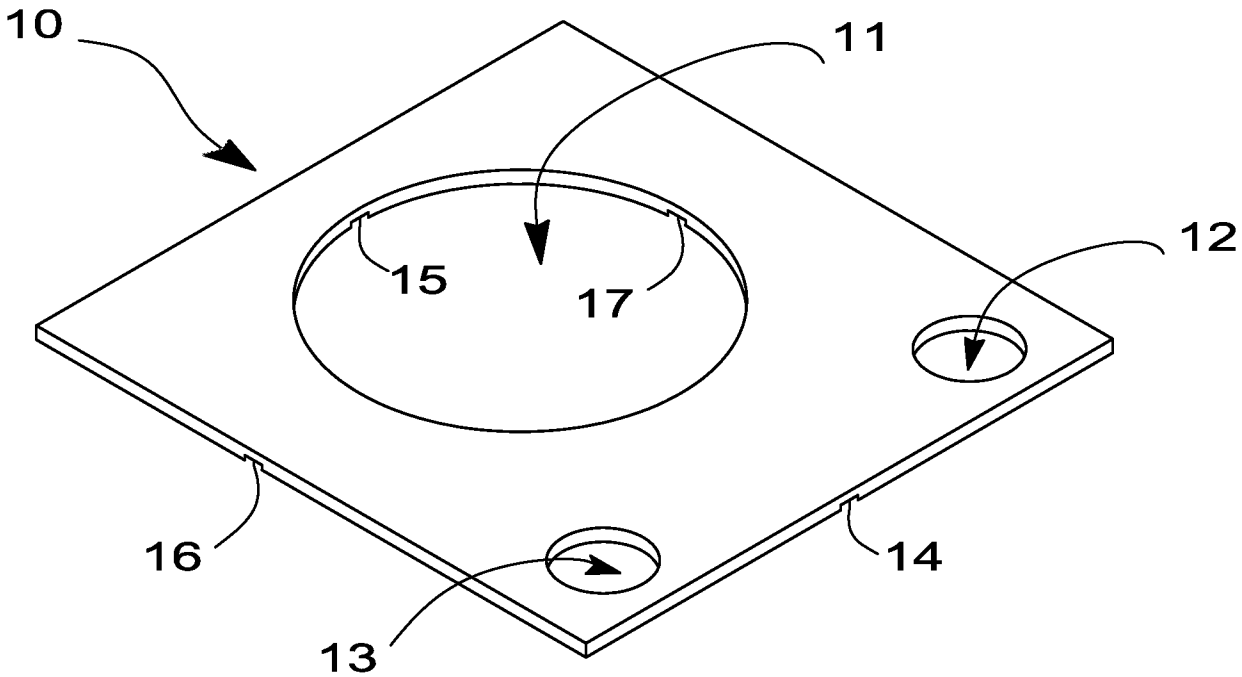
Figure 12:
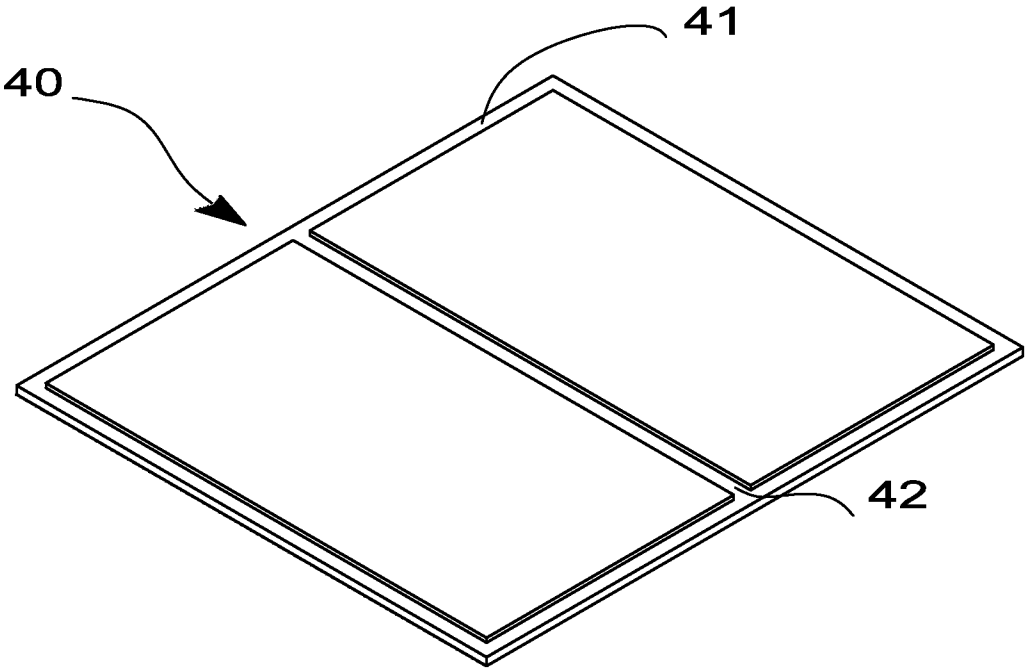
Figure 13:
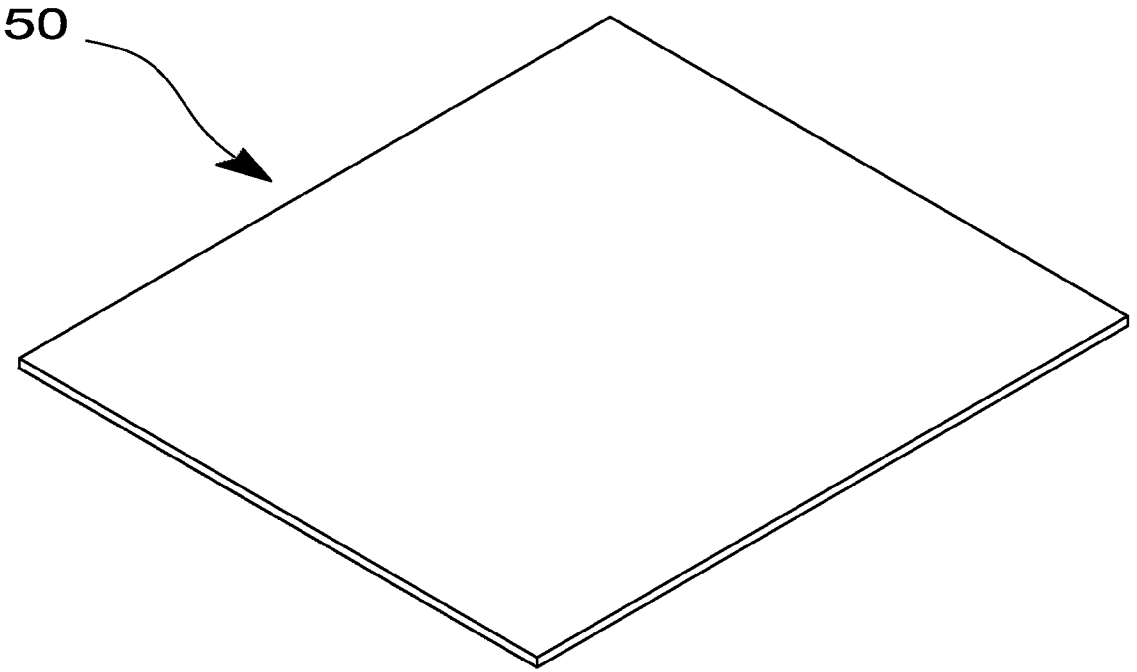
Figure 14:
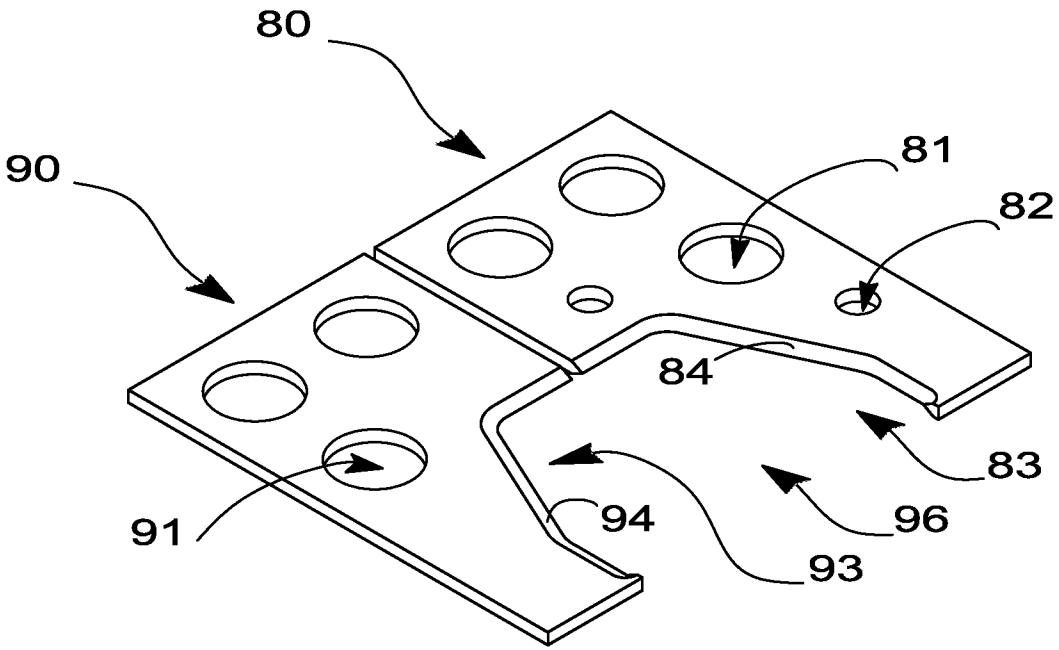
Figure 15:
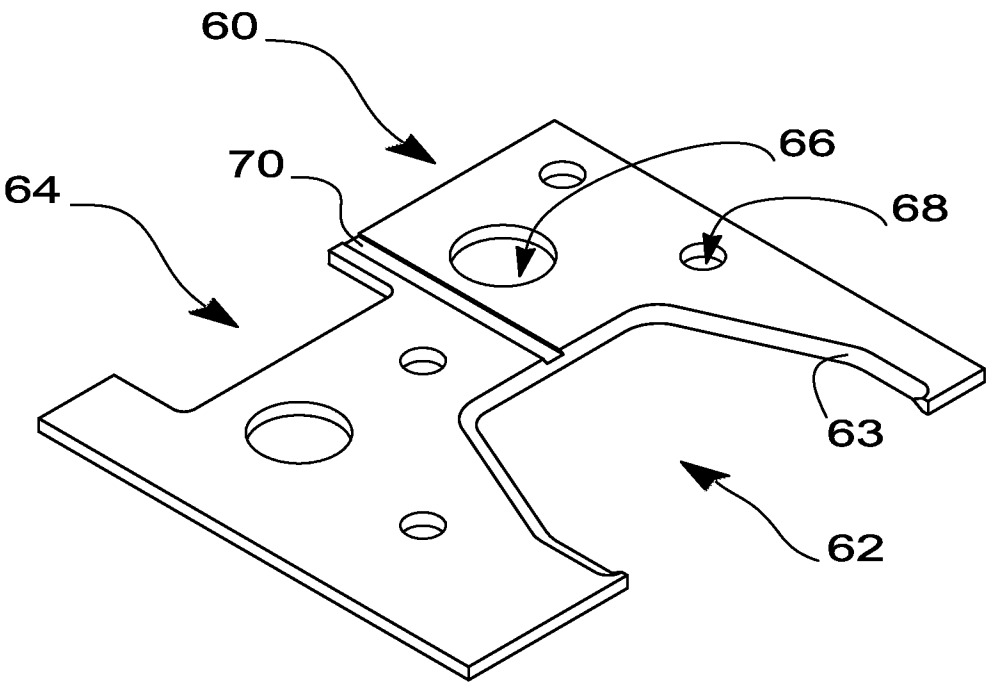
Figure 16:
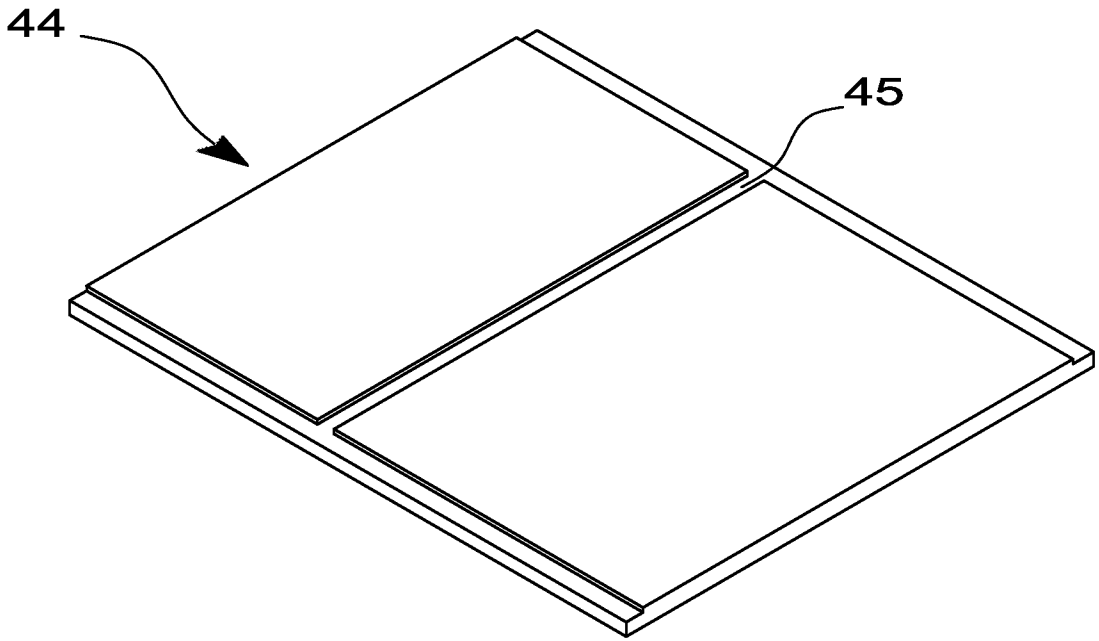
Figure 17:
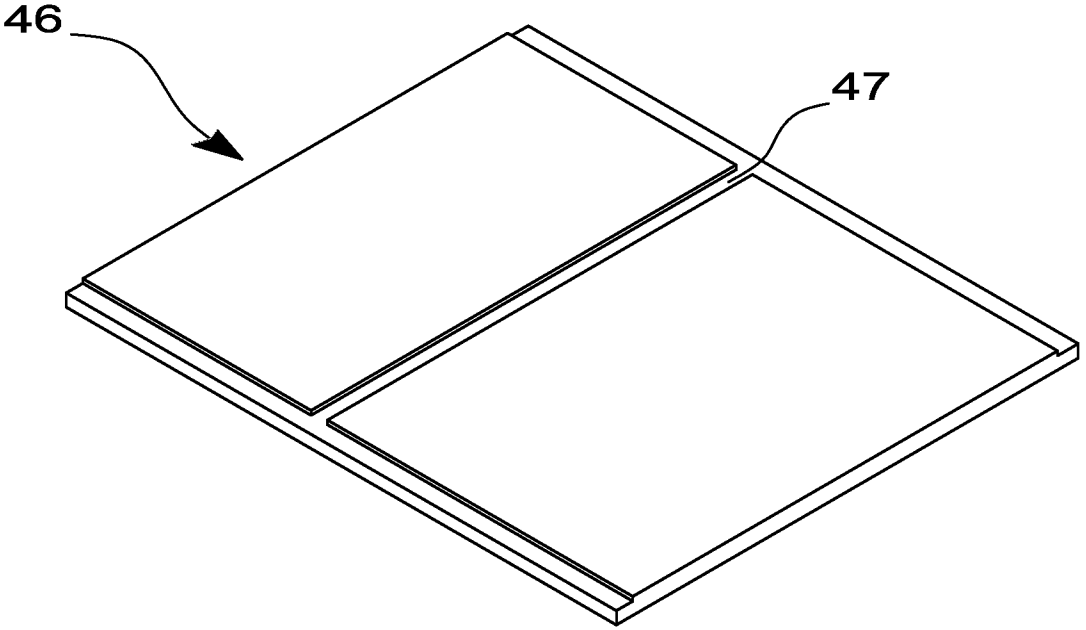

In describing the operation of loudspeaker enclosure 1 in further detail, reference is made to FIGS. 6-8. Specifically, for loudspeaker assembly 150, when an electrical signal is applied to the voice coil, a magnetic field is created by the electric current in the voice coil, making it a variable electromagnet. The coil and the driver's magnetic system interact, generating a mechanical force that causes the coil (and thus, the attached cone) to move back and forth. As the cone moves back, air is forced through loudspeaker port or rear vent 159. This air moves smoothly through wind port 100 (through the four through aerodynamic pathways 103, 106, 109, and 112 defined by orthogonal wall member pairs 101 and 102, 104 and 105, 107 and 108, and 110 and 111, respectively) and freely over the internal brace assembly (over beveled edges 63, 84, and 94 of braces 60, 80, and 90, respectively) into the enclosed air volume away from the cone.

Alternatively, in implementations where wind port 100 is not employed, the air from port or rear vent 159 still moves smoothly and freely over the internal brace assembly (over beveled edges 63, 84, and 94 of braces 60, 80, and 90, respectively) into the enclosed air volume away from the cone.

In places where the description above refers to particular implementations, it should be readily apparent that a number of modifications may be made without departing from the spirit thereof and that these implementations may be alternatively applied. The accompanying CLAIMS are intended to cover such modifications as would fall within the true spirit and scope of the disclosure set forth in this document. The presently disclosed implementations are, therefore, to be considered in all respects as illustrative and not restrictive, the scope of the disclosure being indicated by the appended CLAIMS rather than the foregoing DESCRIPTION. All changes that come within the meaning of and range of equivalency of the CLAIMS are intended to be embraced therein.

The invention claimed is:

1. A loudspeaker enclosure comprising:

a plurality of exterior panels enclosing an air volume;

a first brace disposed within the air volume and comprising a first reentrant through opening shaped to closely follow a profile of loudspeaker assembly components within the enclosed air volume;

a second brace disposed within the air volume and comprising a second reentrant through opening shaped to closely follow a profile of loudspeaker assembly components within the enclosed air volume; and a third brace disposed within the air volume and comprising a third reentrant through opening shaped to closely follow a profile of loudspeaker assembly components within the enclosed air volume;

wherein a left edge of the second brace is coupled along its entire length to a right surface of the first brace opposite the third brace such that the second brace is in an orthogonal orientation with respect to the first brace; and wherein a right edge of the third brace is coupled along its entire length to a left surface of the first brace opposite the second brace such that the third brace is in an orthogonal orientation with respect to the first brace.

2. The loudspeaker enclosure of claim 1 wherein the first brace is coupled to an inside surface of a front exterior panel, a back exterior panel, a top exterior panel, and a bottom exterior panel.

3. The loudspeaker enclosure of claim 2 wherein:

back edges of the first brace adjacent the first reentrant opening are coupled along their entire lengths to the inside surface of the back exterior panel;

a top edge of the first brace is coupled along its entire length to the inside surface of the top exterior panel;

a bottom edge of the first brace is coupled along its entire length to the inside surface of the bottom exterior panel; and front edges of the first brace adjacent the first reentrant opening are coupled along their entire lengths to the inside surface of the front exterior panel adjacent a loudspeaker assembly.

4. The loudspeaker enclosure of claim 1 wherein the first reentrant through opening is within 0.25 to 2.00 inches away from the profile of the loudspeaker assembly components within the enclosed air volume.

5. The loudspeaker enclosure of claim 1 wherein an edge of the first brace defining the first reentrant opening is a beveled edge that allows air to freely flow out of a loudspeaker's rear vent.

6. The loudspeaker enclosure of claim 1 wherein the second brace is coupled to an inside surface of a front exterior panel, a back exterior panel, and a right side exterior panel.

7. The loudspeaker enclosure of claim 6 wherein:

a back edge of the second brace is coupled along its entire length to the inside surface of the back exterior panel;

a right edge of the second brace is coupled along its entire length to the inside surface of the right side exterior panel;

a left edge of the second brace is coupled along its entire length to a right surface of the first brace; and a front edge of the second brace adjacent the second reentrant opening is coupled along its entire length to the inside surface of the front exterior panel adjacent a loudspeaker assembly.

8. The loudspeaker enclosure of claim 1 wherein the second reentrant through opening is within 0.25 to 2.00 inches away from the profile of the loudspeaker assembly components within the enclosed air volume.

9. The loudspeaker enclosure of claim 1 wherein an edge of the second brace defining the second reentrant opening is a beveled edge that allows air to freely flow out of a loudspeaker's rear vent.

10. The loudspeaker enclosure of claim 1 wherein the third brace is coupled to an inside surface of a front exterior panel, a back exterior panel, and a left side exterior panel.

11. The loudspeaker enclosure of claim 6 wherein:

a back edge of the third brace is coupled along its entire length to the inside surface of the back exterior panel;

a left edge of the third brace is coupled along its entire length to the inside surface of the left side exterior panel;

a right edge of the third brace is coupled along its entire length to a left surface of the first brace; and a front edge of the third brace adjacent the third reentrant opening is coupled along its entire length to the inside surface of the front exterior panel adjacent a loudspeaker assembly.

12. The loudspeaker enclosure of claim 1 wherein the third reentrant through opening is within 0.25 to 2.00 inches away from the profile of the loudspeaker assembly components within the enclosed air volume.

13. The loudspeaker enclosure of claim 1 wherein an edge of the third brace defining the third reentrant opening is a beveled edge that allows air to freely flow out of a loudspeaker's rear vent.

14. The loudspeaker enclosure of claim 1 further comprising a wind port comprising a splitter that transitions into four through aerodynamic pathways defined by four orthogonal wall member pairs, respectively, that fit over an intersection of the first brace with both the second brace and the third brace.

15. The loudspeaker enclosure of claim 14 wherein the wind port is within 0.125 to 2.000 inches away from the profile of the loudspeaker assembly components within the enclosed air volume.

16. A loudspeaker enclosure comprising:

a plurality of exterior panels enclosing an air volume;

at least one loudspeaker coupled to a front exterior panel so as to have a front diaphragm surface exposed to a listening space and a rear diaphragm surface exposed to the enclosed air volume;

a first brace disposed within the air volume and comprising a first reentrant through opening shaped to closely follow a profile of loudspeaker assembly components within the enclosed air volume, the first brace coupled to an inside surface of a front exterior panel, a back exterior panel, a top exterior panel, and a bottom exterior panel;

a second brace disposed within the air volume and comprising a second reentrant through opening shaped to closely follow a profile of loudspeaker assembly components within the enclosed air volume, the second brace coupled to the first brace and an inside surface of a front exterior panel, a back exterior panel, and a right side exterior panel;

a third brace disposed within the air volume and comprising a third reentrant through opening shaped to closely follow a profile of loudspeaker assembly components within the enclosed air volume, the third brace coupled to the first brace and an inside surface of a front exterior panel, a back exterior panel, and a left side exterior panel; and wherein a left edge of the second brace is coupled along its entire length to a right surface of the first brace opposite the third brace such that the second brace is in an orthogonal orientation with respect to the first brace; and wherein a right edge of the third brace is coupled along its entire length to a left surface of the first brace opposite the second brace such that the third brace is in an orthogonal orientation with respect to the first brace.

17. The loudspeaker enclosure of claim 16 wherein an edge of the first brace defining the first reentrant opening, an edge of the second brace defining the second reentrant opening, and an edge of the third brace defining the third reentrant opening each is a beveled edge that allows air to freely flow out of a loudspeaker's rear vent.

18. The loudspeaker enclosure of claim 16 further comprising a wind port comprising splitter that transitions into four through aerodynamic pathways defined by four orthogonal wall member pairs, respectively, that fit over an intersection of the first brace with both the second brace and the third brace.

* * * * *